United States Patent [19]

Cosentino

[11] Patent Number: 4,503,654

[45] Date of Patent: Mar. 12, 1985

[54] METHOD AND APPARATUS FOR LAYING TILE

[76] Inventor: Edward Cosentino, P.O. Box 2323, Naples, Fla. 33939

[21] Appl. No.: 422,649

[22] Filed: Sep. 24, 1982

[51] Int. Cl.[3] ..... E04C 21/22; E04F 13/08

[52] U.S. Cl. ..... 52/747; 52/392

[58] Field of Search ..... 52/392, 390, 391, 592, 52/747

[56] References Cited

U.S. PATENT DOCUMENTS

| | | | |
|---|---|---|---|
| 2,111,003 | 3/1938 | Petty | 52/392 |
| 3,041,785 | 7/1962 | MacDonald | 52/392 |
| 3,234,692 | 2/1966 | Bierlich | 52/392 |

*Primary Examiner*—John E. Murtagh
*Assistant Examiner*—Kathryn L. Ford
*Attorney, Agent, or Firm*—Merrill N. Johnson

[57] ABSTRACT

Method and apparatus for constructing a surface from a plurality of similar polygonal tiles wherein the tile has affixed to 50% of its sides one or more spacer members, each spacer member having a flat base and a rectangular flange bisecting the base, said spacer members being securely affixed to the rear face of the tile or to the flat base of an indentation in said base with the flange of the spacer member resting against the side of the tile. The tile is laid onto a bed of wet cement with a projecting portion of the spacer member lying on the surface of the bed. A second tile is laid onto the bed so that the rear face of the tile will rest on the base of a spacer member affixed to the first tile with one side of the second tile resting against the flange of the said spacer member. Successive tiles are then laid on said bed with their rear faces resting upon the base of a spacer member of an adjacent tile and the side of the tile resting against the flange of the spacer member.

2 Claims, 7 Drawing Figures

METHOD AND APPARATUS FOR LAYING TILE

BACKGROUND AND SUMMARY OF THE INVENTION

My invention provides a unique method and apparatus to facilitate the laying of tile with the front faces of all tiles lying in a common plane and with uniform and accurately aligned spaces between adjoining tiles.

The usual procedure in laying tile is to first apply a coating of wet cement or mastick to the surface to be tiled, and then to place the individual tiles edge to edge upon the bed of wet cement. To obtain a secure bond between the tiles and the cement, it is the practice to tamp the tiles in order to embed the rear faces of the tiles into the wet cement. This tamping usually leads to varying spaces between tiles and tipping of some tile faces, resulting in an unsatisfactory, irregular appearance of the tiled surface.

In addition, tiles are often laid upon an under surface which itself is not entirely flat and smooth, resulting in a finished tiled surface having a wavy or broken appearance with irregular spaces between adjacent tiles.

In the past laying tiles with all front faces lying in a common plane and with uniform spacing between tiles could be achieved only by the painstaking labor of skilled craftsmen, often using such time-consuming expedients as heavy cord extended between the rows of tile. And the difficulties were increased when it was sought to apply the tiles to walls or other vertical under surfaces.

My invention provides exact alignment and spacing between adjacent tiles and insures that the front faces of all tiles will lie in a common plane despite irregularities in the under surface upon which the tiles are laid. Moreover, the tiles can be laid by relatively unskilled labor and usually in less time than previously required by skilled craftsmen.

My invention begins with a square, rectangular, hexagonal or octagonal tile made from marble, granite, ceramics or the like. The tile has a front face usually polished or decorated and a rear face usually rough and often, especially in the case of marble and granite, not exactly parallel with the front face of the tile. The sides of the tile are generally flat and smooth and at 90° to the front face of the tile.

To this polygonal tile, I securely affix a plurality of spacer members. Preferably the spacer members are made of a tough plastic material such as nylon or styrene. Each has a flat disk-like base with a rectangular flange projecting at 90° from one side of the base so as to bisect the base of the spacer member. The base of the spacer member for attachment to most tiles is about one inch in diameter, but for satisfactory results with large marble tiles having a thickness of more than a half-inch, spacer members with larger base diameters will be required.

The vertical height of the rectangular flange of the spacer member is determined by the distance between the front and rear faces of the tile—the height of the flange always being about 50% of the thickness of the tile or, in the case where the base of the spacer member is affixed to the bottom of a countersunk indentation in the tile (as will hereinafter be described), 50% of the distance between the front face of the tile and the bottom of the countersunk indentation in the tile.

In the case of a square or rectangular tile whose front and rear faces are substantially parallel to each other, as is usually the case with ceramic tile, preferably two spacer members are affixed to each of two adjoining sides of the tile, usually by gluing one-half of the base of the spacer member to the rear face of the tile and gluing the adjoining side of the flange of the spacer member to the side of the tile.

In the case of a tile whose front and rear faces are not parallel, which is often true of large marble tiles, it is necessary to position the spacer members so that the bases of all spacer members affixed to the tile lie exactly the same distance from the front face of the tile. This is best accomplished by grinding a plurality of countersunk half-cylindrical holes in the rear face of the tile, one countersunk hole for each spacer member, and with the flat base of each hole lying at exactly the same distance from the front face of the tile.

Where it is necessary to grind holes in the tiles to position the spacer members at equal distances from the front face of the tile, it will also be necessary to grind similar holes in the remaining sides of each tile so that these sides of the tile will rest upon the bases of spacer members affixed to an adjacent tile, thus positioning the front face of that tile in the same plane as that of the adjoining tiles.

Whether using tiles having spacer members affixed to the rear face of the tiles or to the flat bases of countersunk holes in the sides of the tile, the procedure for laying the tiles is the same. First, a coating of wet cement or mastick is applied to the under surface to be tiled and troweled to a smooth wet surface. Then a single rectangular tile with two spacer members affixed to each of two adjoining sides of the tile as previously described is placed upon the bed of wet cement and lightly tamped into its desired position.

A second tile is then laid along one side of the first tile with its rear face (or the bottom surface of two of its countersunk holes in the case of such a tile) resting upon the bases of two spacer members. In so laying the second tile, its front face will lie in the same plane as the front face of the first tile and its side butting against the flanges of the two spacer members will be exactly parallel to and uniformly spaced from the adjacent side of the first tile.

Additional tiles are then laid one at a time following the foregoing procedure to achieve the desired precisely uniform appearance of the finished tiled surface.

DETAILED DESCRIPTION OF THE INVENTION

Figure 1:
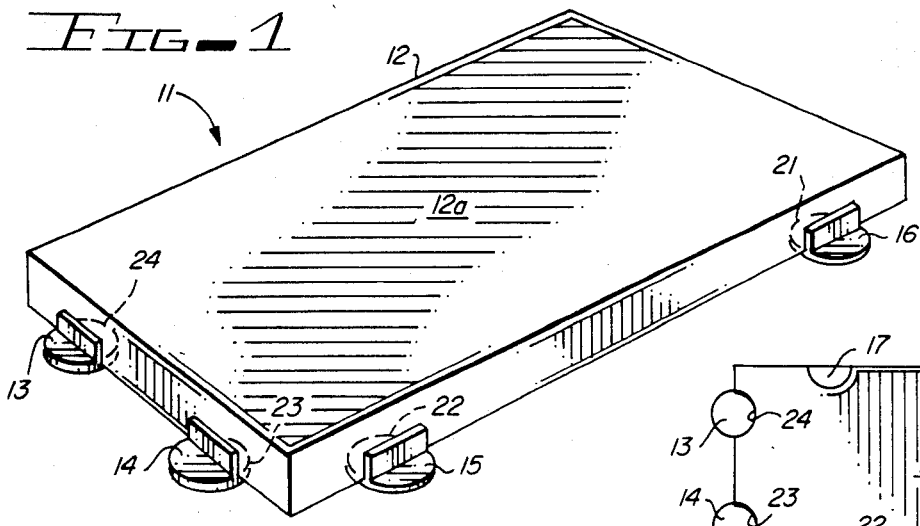
FIG. 1 of the drawings is a perspective view of a rectangular tile modified in accordance with my invention.
Figure 2:
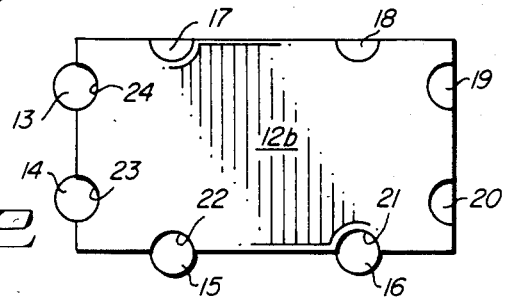
FIG. 2 is a plan view of the rear face of the tile shown in FIG. 1.

Referring to FIGS. 1 and 2 of the drawings, an exemplary embodiment 11 of the invention is shown using a rectangular tile 12 made of marble. Tile 12 has a front face 12*a* which is highly polished and a rear face 12*b* intentionally left rather rough to facilitate embedment of the tile into the layer of cement.

As the result of practices commonly used in the manufacture of marble tiles, especially in larger sizes of tiles, the front and rear faces are often not exactly parallel to each other. In order to assure that the front faces of all tiles lie in a common plane, two half-cylindrical holes are ground into all four sides of the tile 12, which are best shown in FIG. 2 as holes 17, 18, 19, 20, 21, 22, 23 and 24. The bottom of each hole is ground flat and lies at exactly the same distance from front face 12*a* of the tile.

Figure 6:
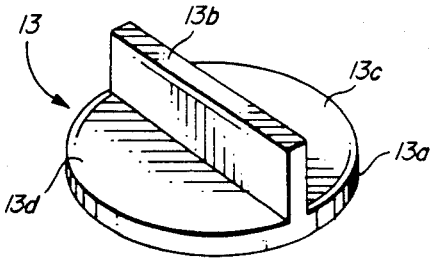
FIG. 6 is a perspective view of one of the spacer members affixed to the tile shown in FIGS. 1 and 2.
Figure 7:
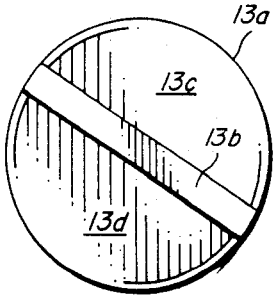
FIG. 7 is a plan view of the spacer member shown in FIG. 6.

Four identical spacer members 13, 14, 15 and 16 are securely affixed to the bottom of holes 24, 23, 22 and 21 respectively. Spacer members can be made from a variety of materials but nylon and styrene have been found to be most satisfactory due to their strength and ready bonding with the tile. FIGS. 6 and 7 show the construction of a preferred form of my spacer member 13. Each spacer member has a flat disk-like base 13*a* which as shown is circular but which could be square or oval.

A rectangular flange 13*b* projects at 90° from one side of base 13*a* and the height of flange 13*b* is approximately 50% of the distance between the front face of the tile and the flat base of the countersunk hole in the tile. The flange 13*b* substantially bisects the face of base 13*a* to which it is attached, thus dividing the base into two halves 13*c* and 13*d*.

Using an epoxy glue or similar adhesive which bonds securely to both marble and the spacer material, surface 13*c* of spacer member 13 is affixed to the base of hole 24 with the adjacent face of flange 13*b* securely glued to the side of tile 12, thus leaving surface 13*d* projecting outwardly from tile 12 and parallel to tile front face 12*a*. Spacer members 14, 15 and 16 are similarly affixed to tile 12 at holes 23, 22 and 21 respectively as best shown in FIG. 1. The outwardly projecting portions of all spacers 13, 14, 15 and 16 will lie in a common plane parallel to the plane of tile face 12*a*.

Figure 3:
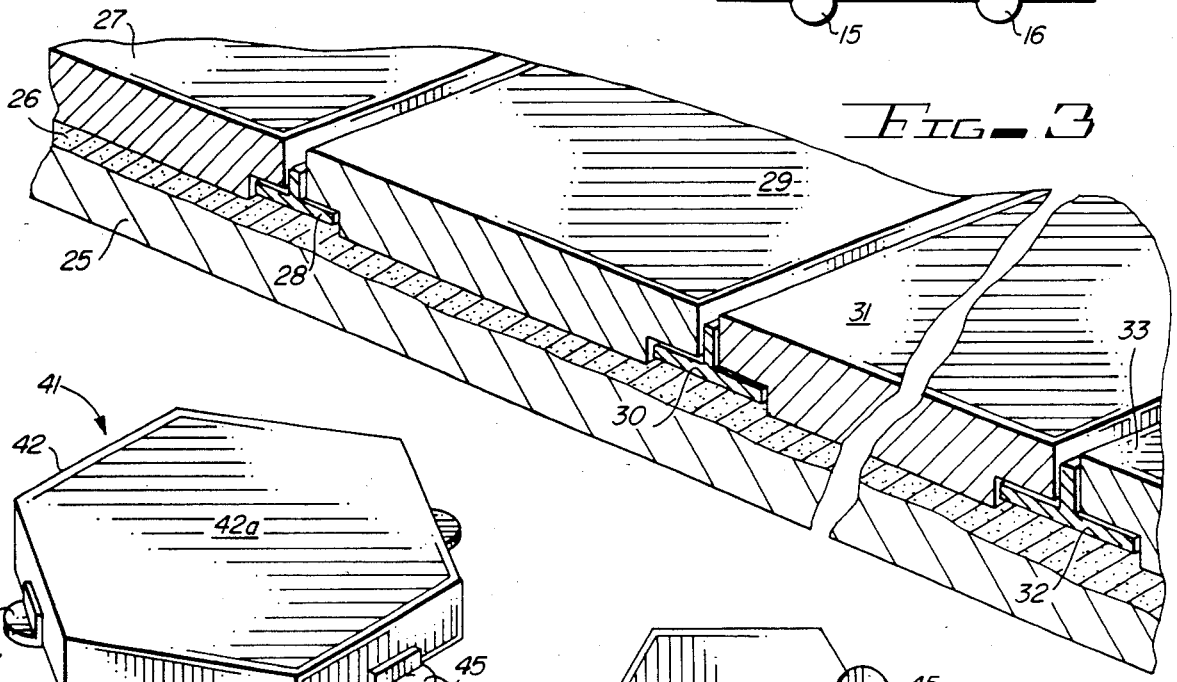
FIG. 3 is a broken away perspective view of a plurality of rectangular tiles laid in accordance with my invention.

FIG. 3 shows how tiles with affixed spacer members are laid with all tile front faces lying in a common plane and with perfectly aligned and equal spacing between all adjoining tiles. The tiles are laid upon a bed of wet cement or mastick which in turn is laid upon an under surface such as the floor or wall of a building. Under surface 25 is shown in FIG. 3 with an irregular, uneven upper surface as is often the case. Onto under surface 25 is spread a bed 26 of wet cement which is troweled smooth.

Tiles 27, 29, 31 and 33 are rectangular marble tiles similar to tile 12 previously described, each of tiles 27, 29, 31 and 33 having two half-cylindrical holes ground into all four of its sides and spacer members affixed to the holes in two adjoining sides of each tile.

Tile 27 is laid upon the bed 26 of wet cement and lightly tamped into position so that the upper face of spacer member 28 affixed to tile 27 is flush with the surface of the bed of cement and the lower or rear face of the tile is firmly embedded into the cement. Then tile 29 is laid next to tile 27 with bases of the two holes in the side of tile 29 which abuts tile 27 resting upon the projecting upper face of one of the spacer members affixed to tile 28 as shown in FIG. 3.

This, of course, will position the two spacer members including member 30 shown in FIG. 3 flush with the surface of bed 25 and ready to receive the bases of the holes in one side of tile 31. And this positions the spacer members including member 32 attached to tile 31 flush with bed 26 and ready to receive the bases of the holes in tile 33. When tile 33 is then tamped down so that its spacer members are flush with the surface of bed 26, the front faces of all tiles 27, 29, 31 and 33 will lie in the same plane. At the same time the spacings between all adjoining tiles will be uniform since adjoining tiles will be butted against the opposite sides of the flanges of two spacer members. Preferably additional cement may be applied to fill in the spaces between adjoining tiles and to cover up the upper surfaces of the spacer members.

The invention has so far been described as applicable to rectangular tiles of marble. It is apparent that the invention is also applicable to other building materials set into a bed of cement, mastick or other bonding material. And where the tiles are relatively thin and with front and rear faces which consistently lie in a common plane, such as many ceramic tiles, the spacer members may be applied directly to the rear faces of the tiles rather than the countersunk holes in the tile as shown in FIGS. 1 through 3. And when the sides of the tile are relatively short, as less than four inches, only one space member need be affixed to a side of the tile.

Figure 4:
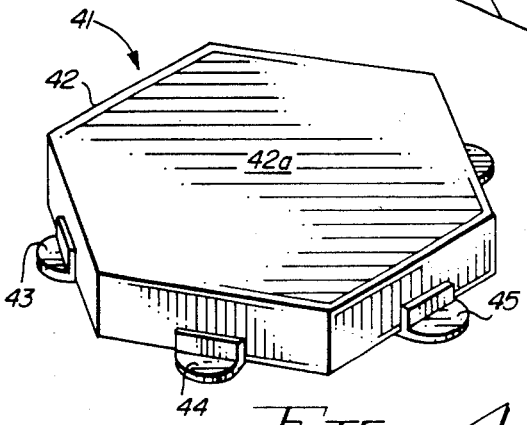
FIG. 4 is a perspective view of a hexagonal tile modified in accordance with my invention.
Figure 5:
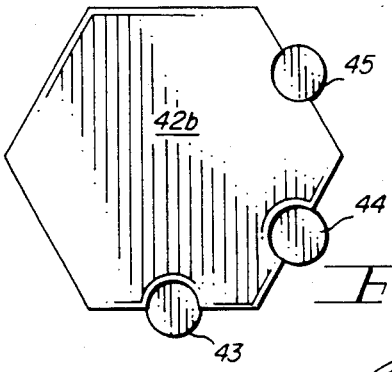
FIG. 5 is a plan view of the rear face of the tile shown in FIG. 4.

A further embodiment 41 of the invention is shown in FIGS. 4 and 5, wherein tile 42 is made of a ceramic material in the form of a hexagon with each side 3 inches long and a front face 42*a* smoothly glazed and rear face 42*b* rough and unglazed. Faces 42*a* and 42*b* are parallel and one-half inch apart. Three spacer members 43, 44 and 45, all similar in construction to spacer member 13 previously described, are affixed to three adjoining sides of ceramic tile 42 by gluing them to the rear face 42*b* as best shown in FIG. 5.

A plurality of tiles 42, each with its attached spacer members 43, 44 and 45, can then be laid in the same manner as previously described with the rear faces of adjacent tiles resting upon the projecting faces of spacer members of the next tile, thereby providing equal spaces between tiles and the front faces of all tiles lying in a common plane.

I have shown preferred embodiments of both the apparatus and method which comprise my invention. However, variations and modifications will be apparent to those skilled in the art. Accordingly, my invention is limited only by the spirit and scope of the appended claims.

I claim:

1. A method of constructing a flat decorative surface from a plurality of similar individual rectangular tiles with an exact predetermined spacing between individual tiles, each tile having a front face intended to form part of said decorative surface and a rear face intended to be bonded to a bed of mortar and four elongated sides lying substantially at 90° to the front and rear faces of the tile, comprising the steps of forming at least two similar indentations in each of the four sides of the tile with each indentation having a flat upper surface parallel to the front face of the tile and the distance between the flat surface of each indentation and the front face of the tile being exactly the same, securely affixing to the flat surface of each indentation in two adjoining sides of the tile one-half of a flat surfaced base of a spacer member, each spacer member having a flat surfaced base and a flat sided flange projecting at 90° from the flat surface of said base and the flange having a thickness equal to the predetermined spacing between individual tiles, positioning one side of the flange of each spacer member against the adjoining side of the tile, laying one of said tiles onto a bed of wet mortar, laying a second tile onto said bed of wet mortar so that the flat surfaces of the indentations in its two sides which do not contain spacer members will each rest upon the base of one of the spacer members of the first tile with one side of the second tile resting against the flanges of said spacer members, and laying successive tiles onto said bed of wet mortar with their indentations which do not contain spacer members resting upon the base of one of the spacer members of an adjacent tile with a side of the tile resting against the flanges of said spacer members.

2. A method of constructing a flat decorative surface from a plurality of similar individual polygonal tiles with an exact predetermined spacing between individual tiles, each tile having a front face intended to form part of said decorative surface and a rear face intended to be bonded to a bed of mortar and at least six elongated sides lying substantially at 90° to the front and rear faces of the tile, comprising the steps of forming at least one indentation in each of the sides of the tile with each indentation having a flat upper surface parallel to the front face of the tile and the distance between the flat surface of each indentation and the front face of the tile being exactly the same, securely affixing to the flat surface of each indentation in adjoining sides comprising 50% of the sides of the tile one-half of a flat surfaced base of a spacer member, each spacer member having a flat surfaced base and a flat sided flange projecting at 90° from the flat surface of said base and the flange having a thickness equal to the predetermined spacing between individual tiles, positioning one side of the flange of each spacer member against the adjacent side of the tile, laying one of said tiles onto a bed of wet mortar, laying a second tile onto said bed of wet mortar so that the flat surface of each indentation in its sides which do not contain spacer members will each rest upon the base of one of the spacer members of the first tile with one side of the second tile resting against the flange of said spacer member, and laying successive tiles onto said bed of wet mortar with their indentations which do not contain spacer members resting upon the base of one of the spacer members of an adjacent tile with a side of the tile resting against the flanges of said spacer members.

* * * * *